US005957056A

United States Patent [19]

Behar

[11] Patent Number: 5,957,056

[45] Date of Patent: Sep. 28, 1999

[54] COMBINED UNDERGROUND (OVER-GROUND) VEHICLE FOR PUBLIC TRANSPORT, FOR HORIZONTAL AND STEEP METROPOLITAN TERRAIN

[76] Inventor: Mario Behar, Columbia University Station P.O. Box 250315, New York, N.Y. 10025-1535

[21] Appl. No.: 08/768,156

[22] Filed: Jul. 31, 1995

[51] Int. Cl.[6] ..... B61B 3/00; B61B 7/00; B61D 17/00

[52] U.S. Cl. ..... 104/89; 104/173.1; 104/202; 105/3; 105/149.1; 105/148

[58] Field of Search ..... 104/87, 89, 91, 104/93, 94, 95, 112, 118, 119, 121, 127, 128, 129, 173.1, 173.2, 178, 180, 182, 193, 115, 202, 204, 212, 209, 218, 222; 105/1.4, 3, 141, 144, 146, 147, 148, 149, 149.1, 149.2, 150, 152, 156

[56] References Cited

U.S. PATENT DOCUMENTS

| | | | |
|---|---|---|---|
| 631,988 | 8/1899 | Feldmann | 105/149 |
| 3,369,501 | 2/1968 | Tsuchimochi | 104/89 |
| 3,610,160 | 10/1971 | Alimanestianu | 104/127 |
| 4,314,512 | 2/1982 | Gerhard et al. | 105/149 |
| 4,691,642 | 9/1987 | Creissels | 105/173.1 |
| 5,197,390 | 3/1993 | Richardson | 105/149.1 |
| 5,226,525 | 7/1993 | Dooley | 105/149 |

*Primary Examiner*—Mark T. Le

[57] ABSTRACT

An underground, on-ground or over-ground public transportation train-like vehicle that can move both on steep-slope terrain and horizontal or semi-horizontal terrain along a straight line or almost straight line route when seen from above, while remaining always in the same train configuration, enabling so the passengers to stay all the time in the same vehicle while moving between any two points at the same or different levels of a hilly city using the shortest in distance and time route, independently of weather conditions. A mobile cabin-to-cabin attachment enables the cabins of said train-like vehicle to vertically displace each with respect to the other and to horizontally rotate each with respect to the other, making thus possible for the passengers to remain in always-upright position and for the vehicle to move on a terrain with constantly changing slope, even when this change is abrupt, and not only along an ideally straight line. A 45°-cabin-to-cable attachment device enables said train-like vehicle, cable-hauled along the sloped sections of the track, to deviate from the straight direction when seen from above, even along the steep sections of said track, between the stations as well as at the stations, without detachment from the cable.

3 Claims, 8 Drawing Sheets

(B)

(A)

(B)

(A)

COMBINED UNDERGROUND (OVER-GROUND) VEHICLE FOR PUBLIC TRANSPORT, FOR HORIZONTAL AND STEEP METROPOLITAN TERRAIN

SUMMARY OF THE INVENTION

This vehicle will be used for public transport in metropolitan areas with varying terrain, such as: (a) combination of horizontal and semi-horizontal lower levels, with deep or shallow valleys, with steep or gradual-slope hills, and plateaus above; or (b) only steep or gradual slopes with almost absent horizontal areas. The vehicle combines the possibilities of an underground or over-ground Metro-type train-like vehicle to move on, under, or above horizontal or semi-horizontal terrains, with the possibilities of a Funicular-type or a Cable-way vehicle to move on, under, or above gradual or steep slopes. The proposed vehicle features also: (a) ability to deviate to the left or to the right from the straight direction of movement in the steep or gradual slope sections; (b) independence from weather conditions; (c) comfort for the passengers to travel all the time in upright position—no matter of the constant change of slope; (d) for long routes there is no need to use cable traction in the horizontal and semi-horizontal sections, bringing so to the minimum the complications produced by the cable elongation under the weight of the passenger cabins (a pair of balanced multi-cabin vehicles—one going up, and the other going down).

With this combined underground and over-ground train-like vehicle for horizontal and steep metropolitan terrain, people will be able to travel in a straight direction or not ideally straight direction using the shortest in distance and time trajectories between any two points at same or different levels of a hilly city, instead of riding buses along the swinging routes up and down the steep slopes of the hills, independently of weather conditions.

BACKGROUND OF THE INVENTION

The up-to-date existing Funicular-type and Cable-way vehicles do not have the versatility to change direction of movement to the left or to the right between the stations. They can do so only at intermediate stations. The Cable-way is totally dependent on weather conditions, especially when strong winds are present. Up-to-date Funiculars have the drawback to require a constant predetermined slope in order to preserve the comfortable vertical position of the passengers, or in other cases said Funiculars guarantee upright position only for the average slope, making the passengers to travel in an uncomfortable inclined position when the slope of the terrain is greater or smaller than the average. Example for the latter case: the funicular in Haifa, Israel. For the cable-hauled Funiculars and the Air-Cabin cableways, the elongation of the cable is a serious complication, when long routes have to be covered. Today, people in a hilly city cannot move from one point to another without having to transfer from one vehicle for the flat part of the city to another vehicle for the steep part of the city, and vice versa. Examples: Underground and tramways for the flat terrain, and funicular, cableway or even vertical elevators for the steep terrain—in Budapest, Hungary; Haifa, Israel, Lisbon, Portugal; etc. The existing alternative is the single-bus travel, but in expense of time due to the prolonged swinging routes from lower to upper points of the city, and vice versa. Examples: Haifa, Jerusalem, Nazareth—in Israel, and many other cities around the world.

DETAILED DESCRIPTION OF THE INVENTION

The vehicle consists of a number of cabins (1), each of them containing two face-to-face sitting benches (15) if the slope of the terrain is steeper, or four sitting benches (15) consisting of two pairs of face-to-face benches (15) for more gradual slope of the terrain. The cabins (1) are attached each to the other by a Cabin-to-Cabin Attachment (4), detailed in FIGS. 1–4. The Cabin-to-Cabin Attachment (4) allows to inter-Cabin Movements—rotation in the horizontal plane about the vertical principal axis, and vertical displacement of one cabin with respect to the other along said vertical axis. Said Cabin-to-Cabin Attachment (4) restrains other four movements—the rotations about the two horizontal principal axes, as well as the displacements of a cabin with respect to the other cabin along those two horizontal axes. The Cabin-to-Cabin Attachment (4) consists of three essential parts: the Hinges (4*c*) that allow the horizontal rotation of a cabin with respect to the other; and the rubber-roller systems (4*a* & 4*b*) that allow the vertical displacement of one cabin with respect to the other. This combination leads to the possibility for a comfortable always-upright position of the passengers. In case of a problem with the Cabin-to-Cabin Attachment (4), the Safety is guaranteed by the (Chain or Cable) Safety Connection between the Cabins (12).

Figure 1:
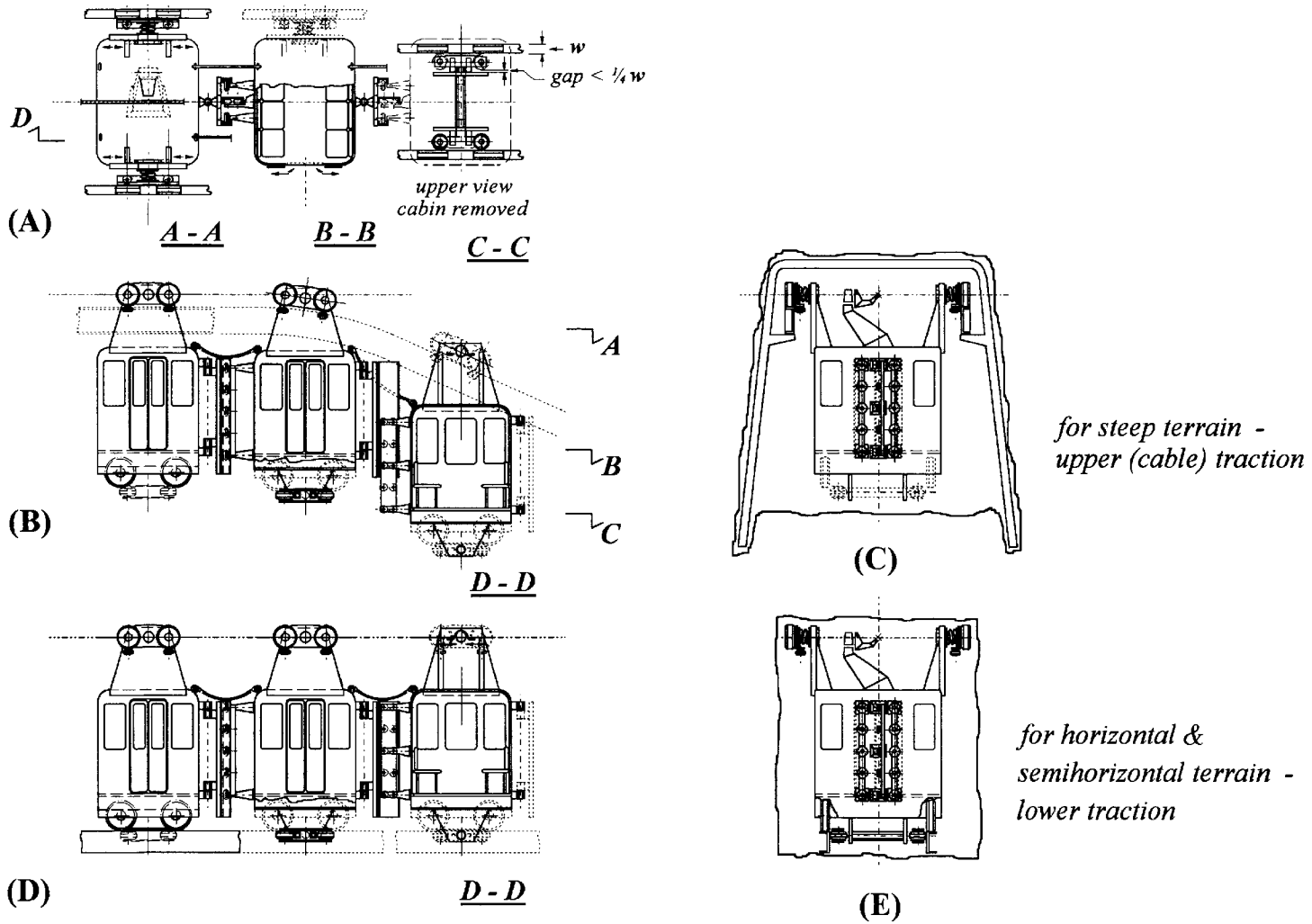
FIG. 1 shows general views of the vehicle of the present invention supported on different types of tracks.
Figure 2:
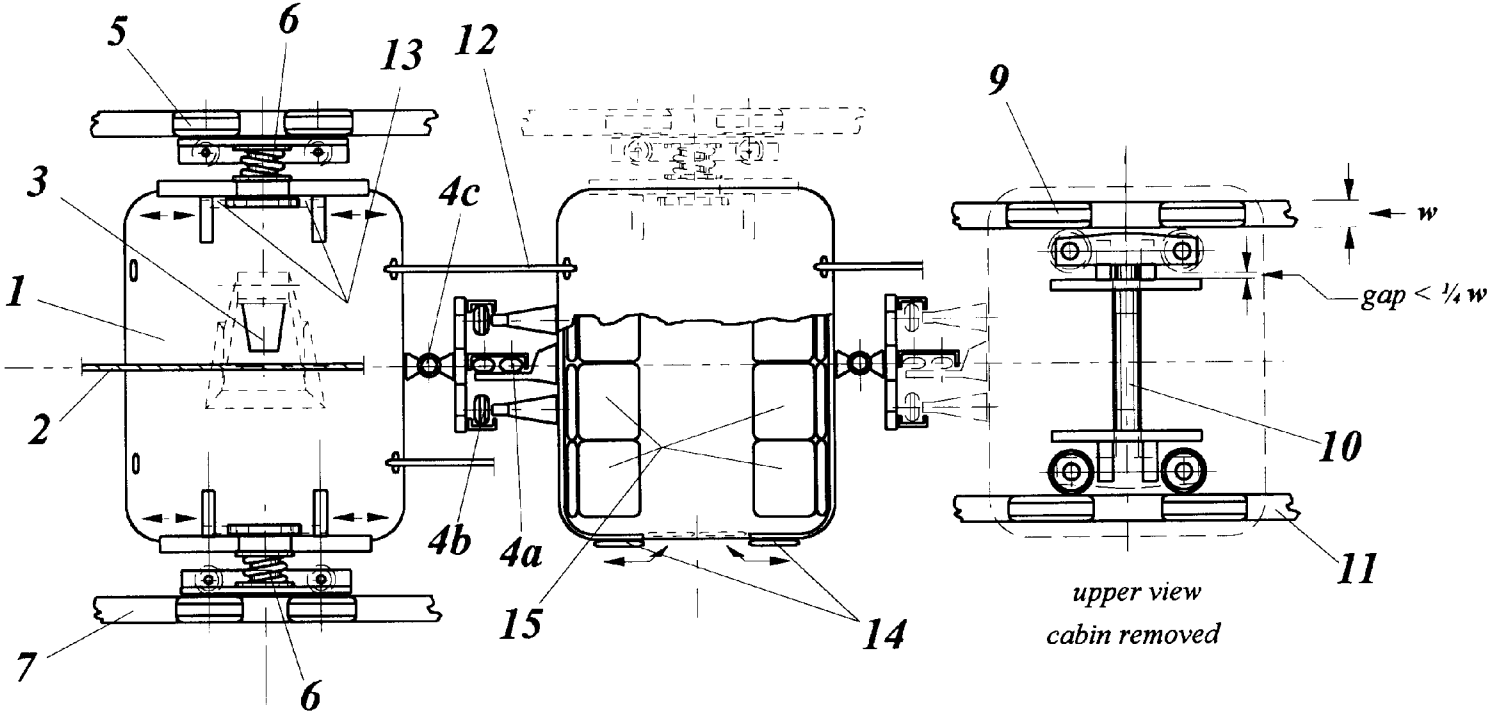
FIG. 2 shows a top view of the vehicle of the present invention with cut away portions to show details.
Figure 3:
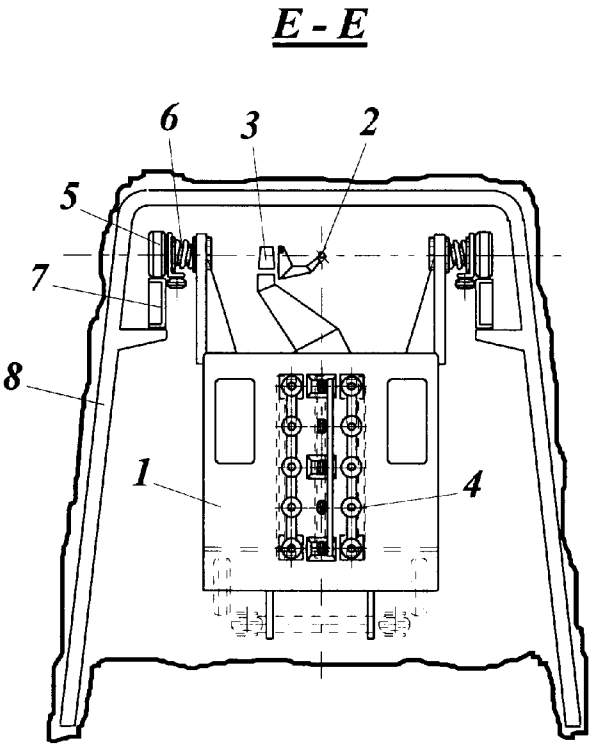
FIG. 3 shows views with details of the vehicle of the present invention suspended on an overhead track with a steep terrain.
Figure 3:
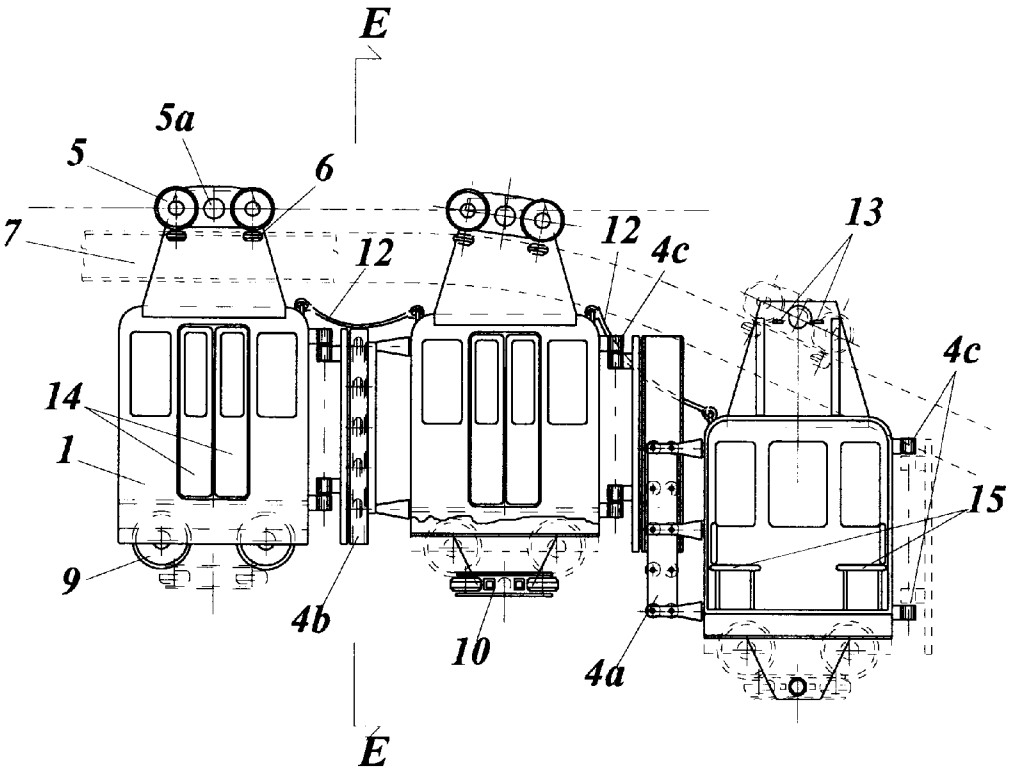
Figure 4:
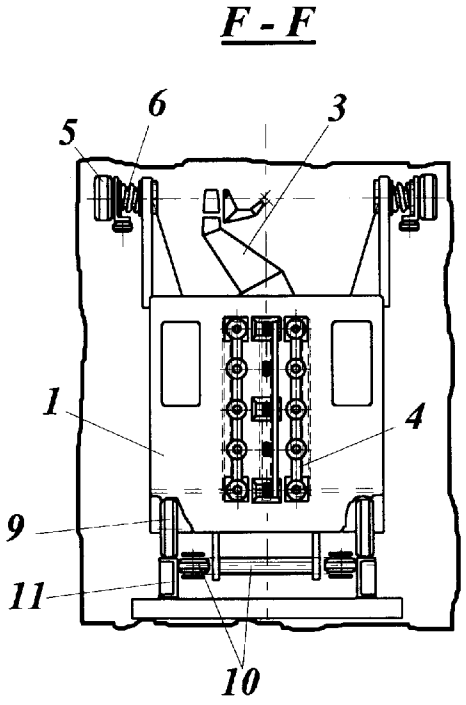
FIG. 4 shows views with details of the vehicle of the present invention supported on a lower track with a horizontal terrain.
Figure 4:
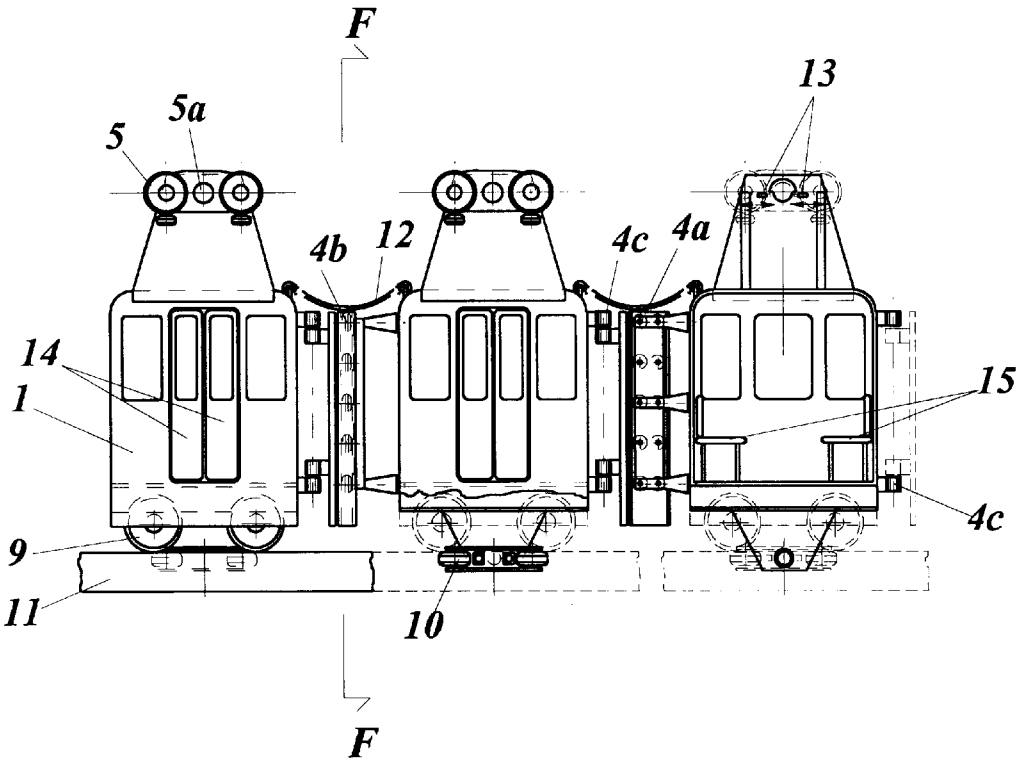
Figure 5:
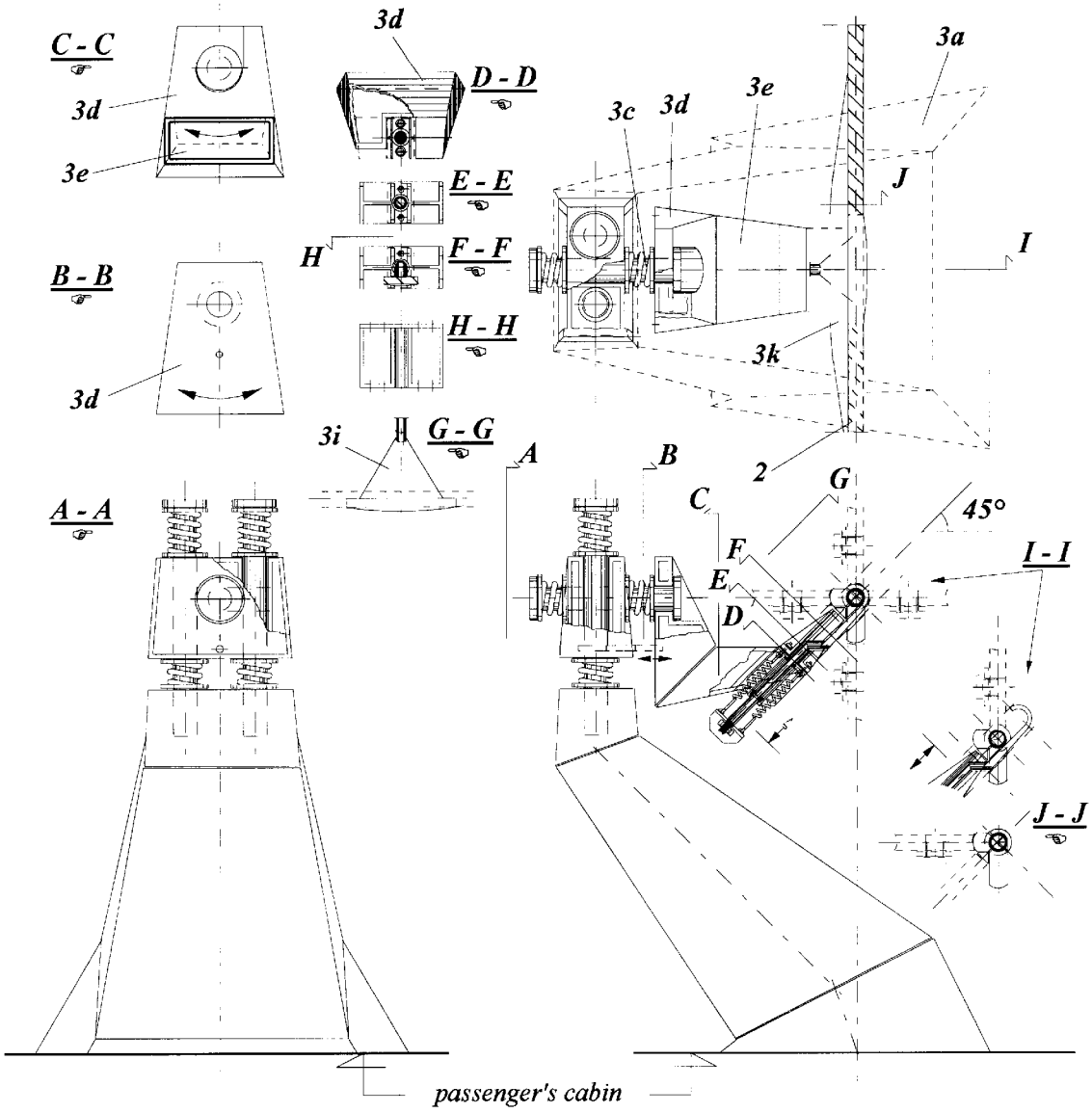
FIGS. 5–7 show views with details of the cabin-to-cable attachment device of the present invention.
Figure 6:
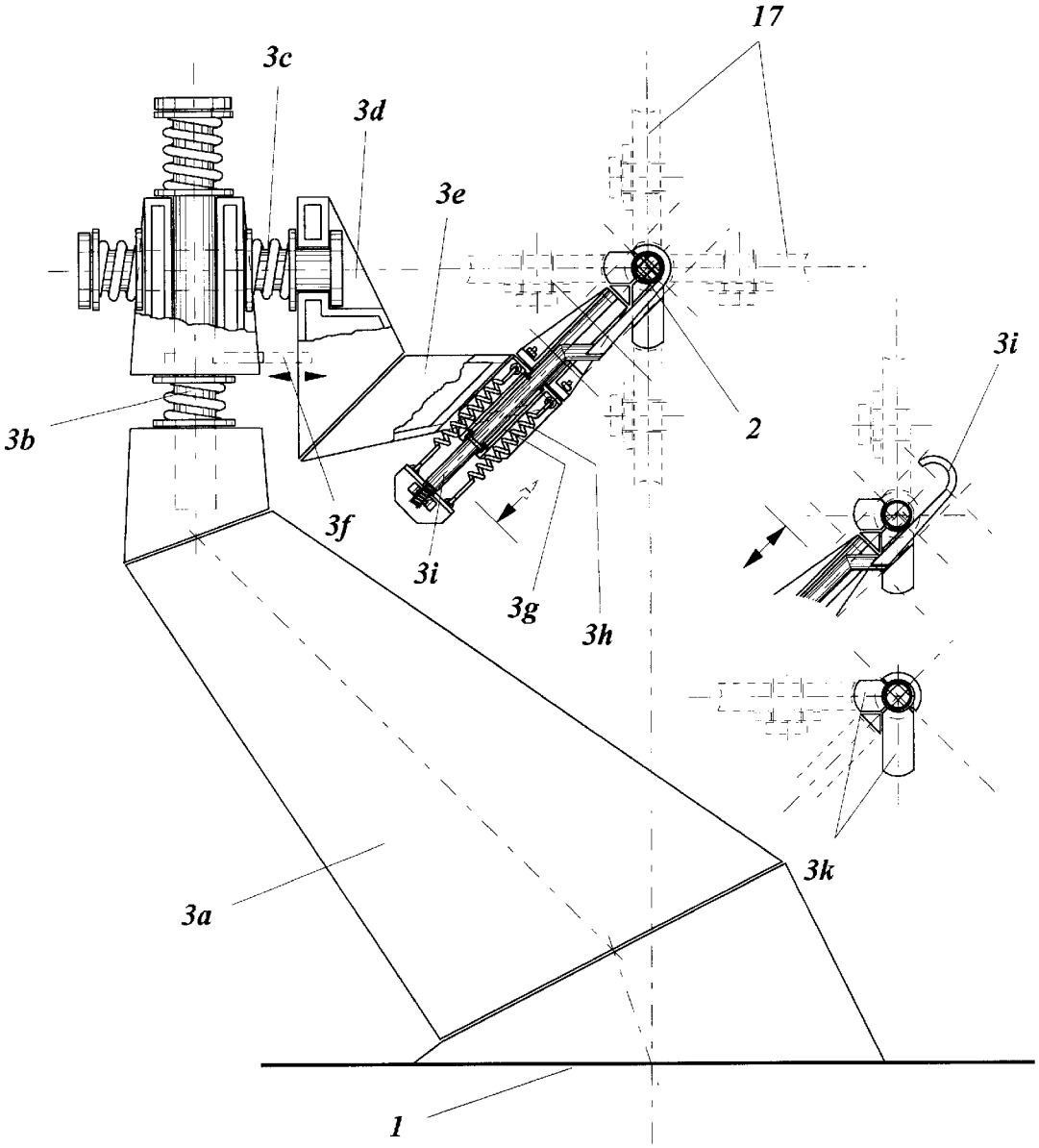
Figure 7:
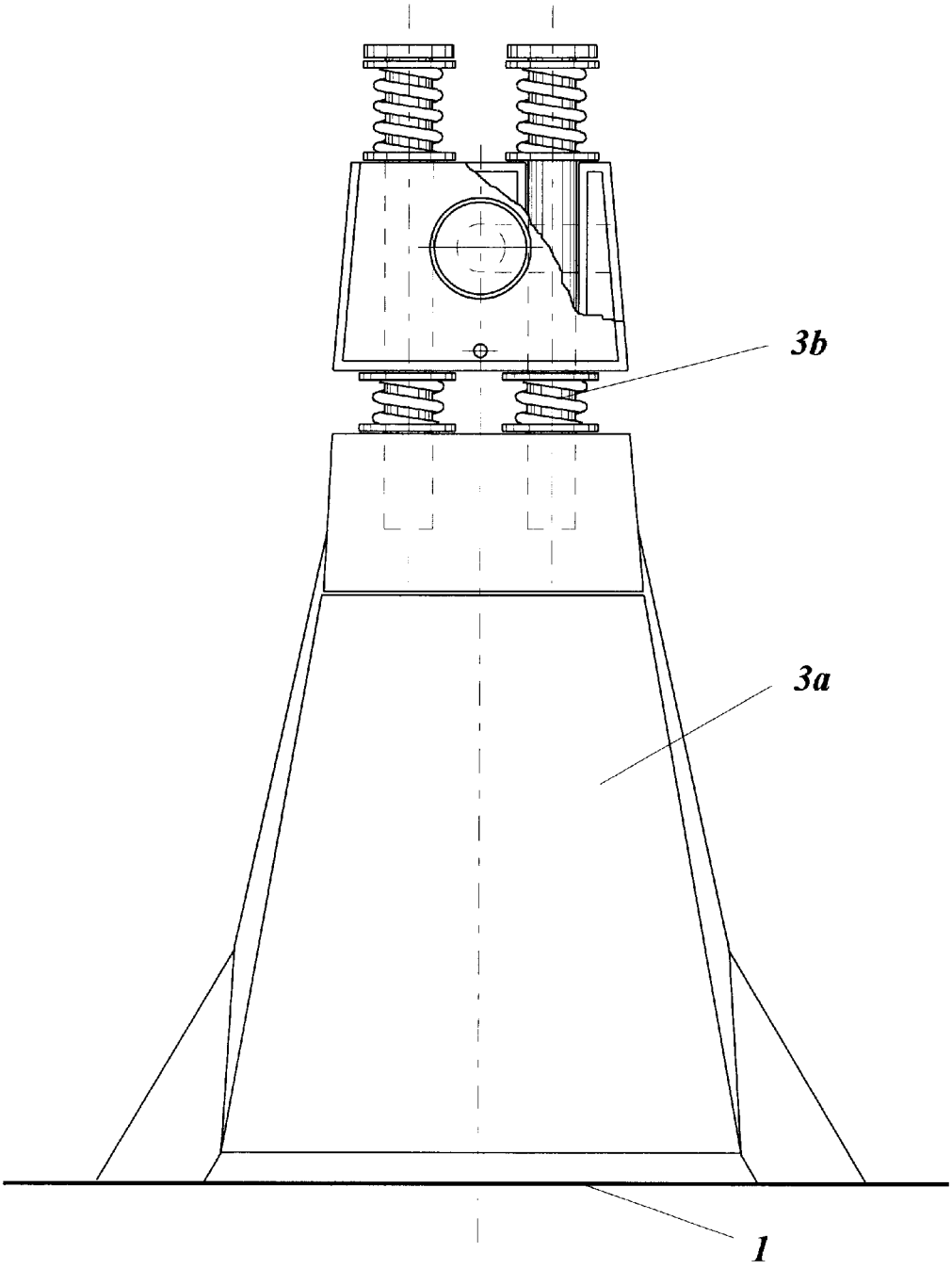

For the steep-slope sections of its track the vehicle is provided with Upper (cable) Traction (3) detailed in FIGS. 5–7. For the horizontal (semi-horizontal) terrain the vehicle uses Lower Traction (not presented here, as being not an innovation). Along the steep-slope section the vehicle moves on the Upper Rails (7) (FIGS. 1 and 3) using two pairs of Upper Wheels (5) hinged with respect to the cabin by Hinges (5*a*). Along the horizontal (semi-horizontal) section the vehicle moves on Lower Rails (11) (FIGS. 1 and 4) using the Lower Wheels (9). During the movement of the vehicle on the Lower Rails, the pairs of Upper Wheels are restrained from turning around the Hinges (5*a*) by Stoppers (13). During Upper Traction, the stability of the vehicle in transverse direction is guaranteed by the Upper Anti-Transverse-Movement Damping System (6). During Lower Traction, said stability is guaranteed by the Lower Anti-Transverse-Movement Damping System (10). The Upper Damping System consists of two Rubber Wheels and a Spring for each side (FIGS. 1 and 3), while the Lower Damping System consists of two Rubber Wheels for each side and a Hydraulic Cylinder that unites both sides (FIG. 4). One of the possibilities to support the vehicle during Upper Traction, in an underground tunnel, is the Upper-Rail Carrying Frame (8) given in FIG. 3.

The Cabin-to-Cable Attachment (3) (FIGS. 5–7) is fixed to the cable (2) at an angle of 45° with respect to the horizontal principal axis perpendicular to the longitudinal vertical plane of the vehicle in order to guarantee the following possibilities between two stations: unobstructed change of slope in the longitudinal vertical plane; as well as unobstructed change of direction (to the left or to the right) in the horizontal plane, being the latter feature possible only at the stations in the cases of the up-to-date prior art. This Cabin-to-Cable Attachment (3) consists of Basement (3*a*); Spring Damping System (3*b*) for the vertical displacements; Spring Damper (3*c*) for the horizontal displacements; Movable Element that guarantees the changeable angle of the Cable (2) with respect to the Attachment (3) in the longitudinal vertical plane (rotation about the horizontal principal axis perpendicular to said vertical plane), being said Movable Element formed of two bodies (3*d*) & (3*e*) attached at an angle of 90° each to the other; Stopper (3*f*) (FIG. 6) for the horizontal position of the Movable Element, when the latter is not in use during movement of the vehicle using Lower Traction; Hydraulic Cylinder (3*g*) (FIG. 6) which fastens the cable (2) to the attachment (3) using the Upper Fastening Element or Grip (3*i*); Springs (3*h*) which release the cable (2) from the attachment (3) when the hydraulic cylinder (3*g*) is depressurized; and Horizontal & Vertical front and rear Wedge Elements (3*k*), which guarantee additional distance between the cable (2) and the Deviation Sheaves (17) for the undisturbed and smooth rolling of the latter ones when the attachment (3) passes by them.

As a metropolitan vehicle for public transport, this vehicle will move in most of the cases under ground. Where the conditions permit its tracks can be situated also on ground, as well as over ground. The most economic solution for the underground version in the steep-slope section is when the tracks of both directions are placed each next to the other (the bold lines in FIG. 9) in a "single-tunnel". In the case of on-ground or over-ground steep-slope section, the "divided trajectories" solution (the dashed lines in FIG. 9) will be used in order to reduce the complications in the movement of the cabins (1) and the cable (2) produced by the Sheaves for deviation (17) of the cable from the straight direction.

Figure 9:
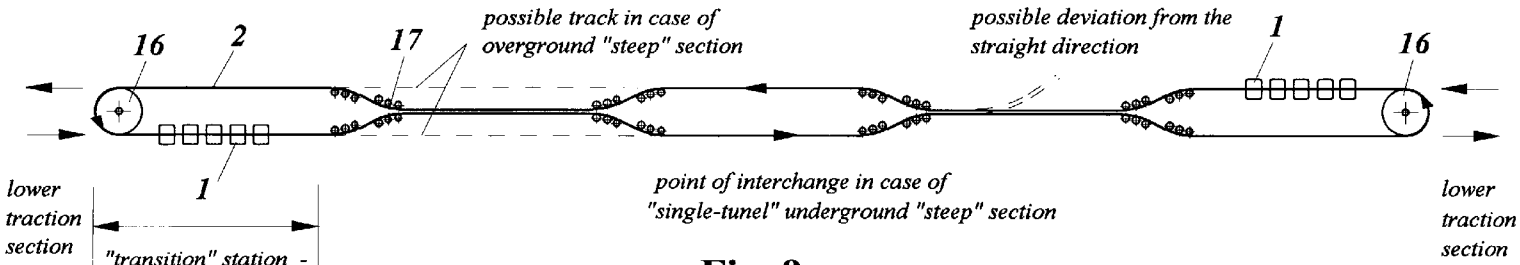
FIG. 9 shows an general view of a cable-traction route.

Lower Traction is chosen for the horizontal sections of the tracks to guarantee Higher Speed, and to make possible the use of more than one pair of multi-cabin vehicles. In the case of FIG. 9 the pairs are at least three—one pair on the Upper (Cable) Traction section, and other two on the two adjacent Lower Traction sections. When the horizontal (semi-horizontal) sections are sufficiently long, the pairs of multi-cabin vehicles can be more than three.

Figure 8:
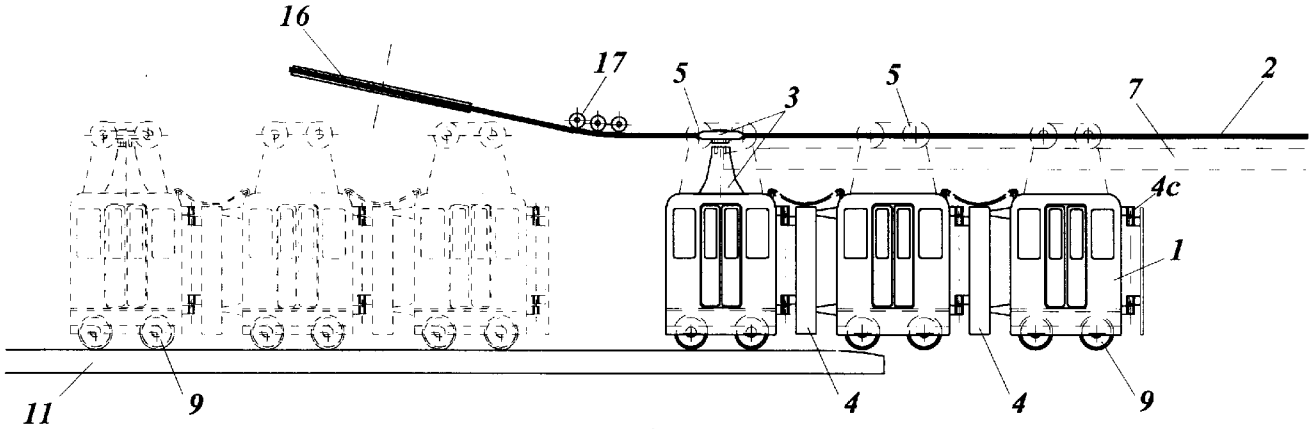
FIG. 8 shows a transition from a lower track to an upper track.
Figure 10:
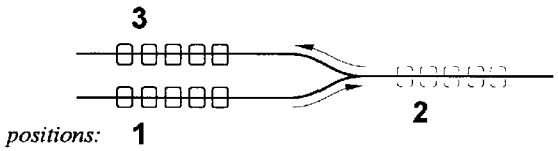
FIG. 10 shows a final station arrangement for changing the traveling direction of the vehicle of the present invention.

The interchange from Upper Traction to Lower Traction, and vice versa is done at a station where the terrain is changing from horizontal (semi-horizontal) to steep (FIGS. 8 & 9). When by coincidence a passenger's station is situated at such a place, the interchange of Tractions is done at the entrance of the station or at the exit from it, i.e. just before or just after the vehicle stops for the passengers to get off or get on. At the corresponding ends, the Upper Rails (7) and the Lower Rails (11) are wedged to guarantee smooth transition (FIG. 8). Where these Rails overlap, the vertical clearance between them is such as to guarantee a gap between the Lower Wheels (9) and lower rails (11) (FIG. 8). The Cabin-to-Cable Attachment (3) is always mounted on the Upper-most Cabin, which is guaranteed by the procedure chosen for the Change of Direction at the Final Stations (FIG. 10): Arrival (position 1); Intermediate (position 2); Departure (position 3). Due to this reason the cabins (1) are equipped with Doors (14) on both sides, one of which will be opened at a time, depending on which side of the cabin the station platform is.

I claim:

1. A transportation system for transporting passengers, comprising:

a track system including at least a lower rigid track, an upper rigid track, and a cable track;

a vehicle adapted to be supported on said tracks, said vehicle including a plurality of interconnected cars connected one to another by a hinge and roller guide arrangement, and means mounted on said cars for supporting and guiding said vehicle on said lower track, upper track and cable track;

wherein said hinge and roller guide arrangement is attached between adjacent ones of said cars and includes hinges connected to at least one of the cars to allow relative horizontal rotations of the cars, and rollers arranged on vertical guides connected to said hinges and to an adjacent one of said cars so to allow relative vertical displacements of the cars; and wherein said means for supporting and guiding said vehicle includes a cable attachment device mounted on an upper part of the cars, said cable attachment device including a plurality of angled members, vertical and horizontal damping devices, and a cable gripping device interconnected one to another so as to attach the vehicle to the cable track at approximately 45 degrees relative to a vertical plane aligned with the longitudinal axis of the cable track.

2. A car-to-car attachment device for coupling cars of a train traveling over a track system, comprising:

a plurality of rollers and a plurality of vertical guides, said rollers adapted to be mounted to an end of one of said cars, and said rollers being arranged to be moved and guided along said vertical guides, said vertical guides being mounted on a support structure supporting first parts of vertical hinges, second parts of said vertical hinges being adapted to be mounted to the end of an adjacent one of said cars; and wherein said hinges are positioned to allow relative horizontal rotations of adjacent cars, and said roller and vertical guides are positioned to allow relative vertical displacements of adjacent cars.

3. A cabin-to-cable attachment device for attaching a plurality of cars of a train to a cable-way, comprising:

an angled base member having one end adapted to be attached to the top of one of said cars, and the other end attached to a damping system which has a vertical damping device and a horizontal damping device arranged at a right angle to each other, a two-piece right angle movable structure attached to an end of the horizontal damping device, and a hydraulic cable gripping assembly attached to an end of the movable structure; wherein, said hydraulic cable gripping assembly, when it is in gripping position with the cable-way, is oriented at an approximately 45 degree angle relative to a vertical plane aligned with the longitudinal axis of the cable-way.

* * * * *